US006205961B1

(12) United States Patent
Bailey et al.

(10) Patent No.: US 6,205,961 B1
(45) Date of Patent: Mar. 27, 2001

(54) FREE PISTON INTERNAL COMBUSTION ENGINE WITH PISTON HEAD FUNCTIONING AS A BEARING

(75) Inventors: Brett M. Bailey; Willibald G. Berlinger, both of Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/252,831

(22) Filed: Feb. 22, 1999

(51) Int. Cl.[7] ..... F02B 71/00
(52) U.S. Cl. ..... 123/46 R
(58) Field of Search ..... 123/46 R, 193.4

(56) References Cited

U.S. PATENT DOCUMENTS

| | | | | |
|---|---|---|---|---|
| 4,020,804 | * | 5/1977 | Bailey | 123/46 R |
| 4,589,380 | * | 5/1986 | Coad | 123/46 R |
| 4,724,800 | * | 2/1988 | Wood | 123/59.7 |
| 4,986,234 | * | 1/1991 | Bell | 123/193.4 |
| 5,033,427 | * | 7/1991 | Kawamura et al. | 123/193.3 |
| 5,437,821 | * | 8/1995 | Diberardino et al. | 264/29.1 |
| 5,540,194 | * | 7/1996 | Adams | 123/46 R |

FOREIGN PATENT DOCUMENTS

| | | |
|---|---|---|
| 1958416 | 5/1971 | (DE) . |
| 48473 | 9/1996 | (DE) . |
| 2214569 | 9/1989 | (GB) . |
| WO 93/10342 | 5/1993 | (WO) . |

OTHER PUBLICATIONS

Application Serial No. 09/082,135 filed May 20, 1998, entitled "Piston for Use in an Engine".

TU Dresden—publication date unknown—earliest date 1993—Dresden University in Germany.

* cited by examiner

*Primary Examiner*—Marguerite McMahon
*Assistant Examiner*—Jason Benton
(74) *Attorney, Agent, or Firm*—Todd T. Taylor

(57) ABSTRACT

A free piston internal combustion engine includes a housing with a combustion cylinder and a second cylinder. A piston includes a piston head reciprocally disposed within the combustion cylinder, a second head reciprocally disposed within the second cylinder, and a plunger rod rigidly attached to each of and interconnecting the piston head and the second head. The piston head defines a bearing with the inside surface of the combustion cylinder. A single bearing is carried by the housing within the second cylinder and reciprocally carries the plunger rod. The single bearing is the only bearing which directly carries the plunger rod.

21 Claims, 3 Drawing Sheets

FREE PISTON INTERNAL COMBUSTION ENGINE WITH PISTON HEAD FUNCTIONING AS A BEARING

TECHNICAL FIELD

The present invention relates to free piston internal combustion engines, and, more particularly, to piston and cylinder configurations within such engines.

BACKGROUND ART

Free piston internal combustion engines include one or more pistons which are reciprocally disposed within corresponding combustion cylinders. However, the pistons are not interconnected with each other through the use of a crankshaft. Rather, each piston is typically rigidly connected with a plunger rod which is used to provide some type of work output. For example, the plunger rod may be used to provide electrical power output by inducing an electrical current, or fluid power output such as pneumatic or hydraulic power output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the top dead center (TDC) position.

In a free piston internal combustion engine as described above, the plunger rod is slidingly carried by a pair of bearings/seals which are respectively disposed between the combustion cylinder and the compression cylinder, and the compression cylinder and the hydraulic cylinder. Each bearing/seal allows reciprocating movement of the plunger rod while at the same time sealing around the plunger rod to fluidly separate the associated adjacent cylinders. Since the plunger rod is slidingly carried by the pair of bearings/seals, the longitudinal axis of the plunger rod defines the axis of reciprocating movement of the piston. Because of manufacturing tolerances, etc., it is possible that the piston head may not be disposed exactly concentrically with the longitudinal axis of the plunger rod. Alternatively, it is possible that the longitudinal axis of the combustion cylinder may not be disposed exactly concentric with the longitudinal axis of the plunger rod carried by the pair of bearings/seals.

The present invention is directed to overcoming one or more of the problems as set forth above.

SUMMARY OF THE INVENTION

The present invention provides a free piston internal combustion engine with a piston having a piston head which acts as a bearing within the combustion cylinder to accommodate concentric misalignments between the piston head and plunger rod during use.

In one aspect of the invention, a free piston internal combustion engine includes a housing with a combustion cylinder and a second cylinder. A piston includes a piston head reciprocally disposed within the combustion cylinder, a second head reciprocally disposed within the second cylinder, and a plunger rod rigidly attached to each of and interconnecting the piston head and the second head. The piston head defines a bearing with the inside surface of the combustion cylinder. A single bearing is carried by the housing within the second cylinder and reciprocally carries the plunger rod. The single bearing is the only bearing which directly carries the plunger rod.

An advantage of the present invention is that the piston head and the single bearing carrying the plunger rod form the two bearing points of a sliding mass to accommodate concentric misalignments between the combustion cylinder and the hydraulic cylinder and/or concentric misalignments between the piston head and plunger rod.

Another advantage is that radial loading on the piston head and plunger rod associated with concentric misalignments are reduced or eliminated.

Yet another advantage is that the portion of the piston head defining the bearing surface is constructed from a material having low friction, low thermal expansion and high temperature resistance properties.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
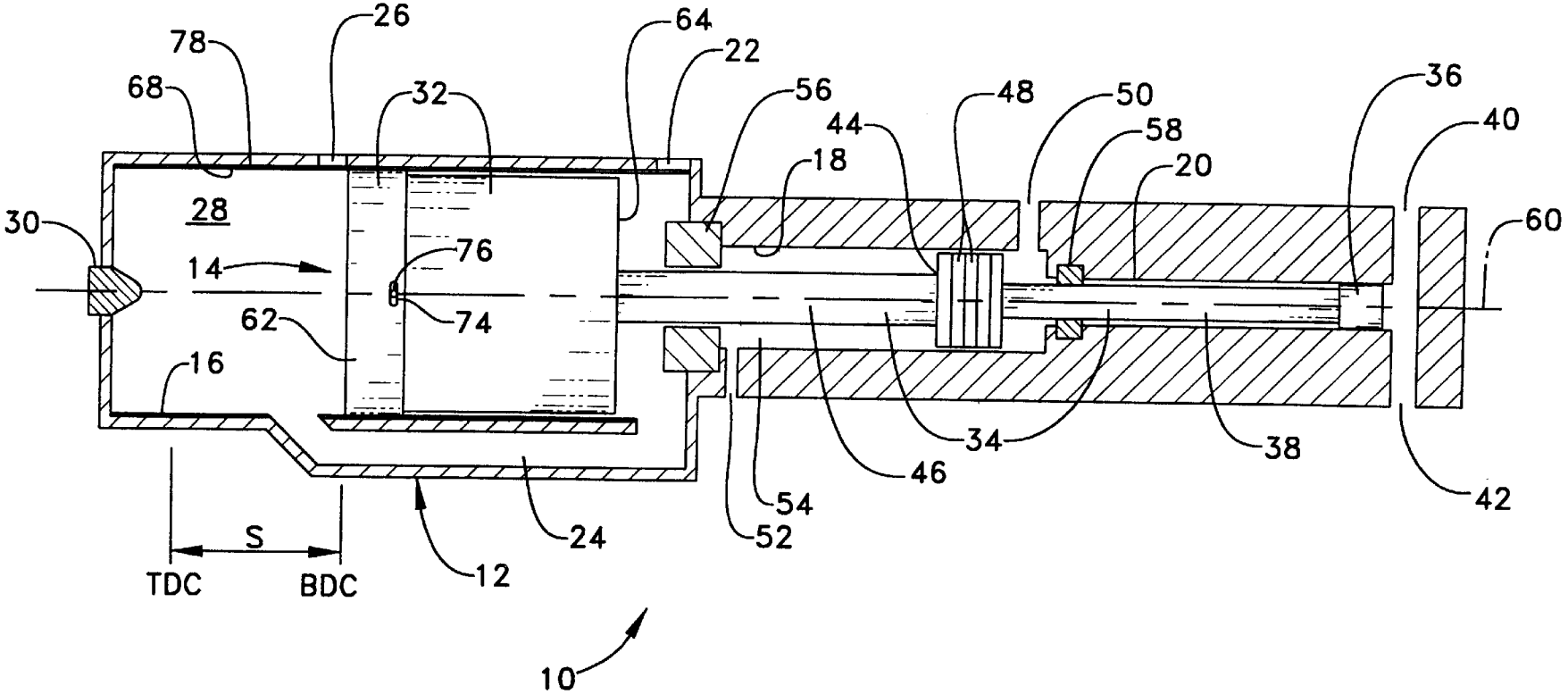
FIG. 1 is a simplified side, sectional view of a portion of a free piston internal combustion engine with an embodiment of a piston of the present invention disposed therein.

Referring now to the drawings, and more particularly to FIG. 1, there is shown a simplified side, sectional view of an embodiment of a portion of a free piston internal combustion engine 10 including a housing 12 and piston 14.

Housing 12 generally includes a combustion cylinder 16, compression cylinder 18 and hydraulic cylinder 20. Housing 12 also includes a combustion air inlet 22, air scavenging channel 24 and exhaust outlet 26 which are disposed in communication with a combustion chamber 28 within combustion cylinder 16. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The stroke length of piston 14 between a BDC position and a TDC position may be fixed or variable.

Piston 14 is reciprocally disposed within combustion cylinder 28 and generally includes a piston head 32 which is attached to a plunger rod 34. A plunger head 36 is attached to a smaller diameter portion 38 of plunger rod 34 at an end generally opposite from piston head 32. Hydraulic cylinder 20 is disposed in communication with each of an inlet port 40 and an outlet port 42 in housing 12. Reciprocating movement of plunger head 36 within hydraulic cylinder 20 causes hydraulic fluid to be drawn into hydraulic cylinder 20 through inlet port 40 from a source of hydraulic fluid, such as a low pressure hydraulic accumulator (not shown), on a compression stroke of piston 14; and causes pressurized hydraulic fluid to be discharged from outlet port 42 to a high pressure hydraulic accumulator (not shown) on a return stroke of piston 14.

Figure 2:
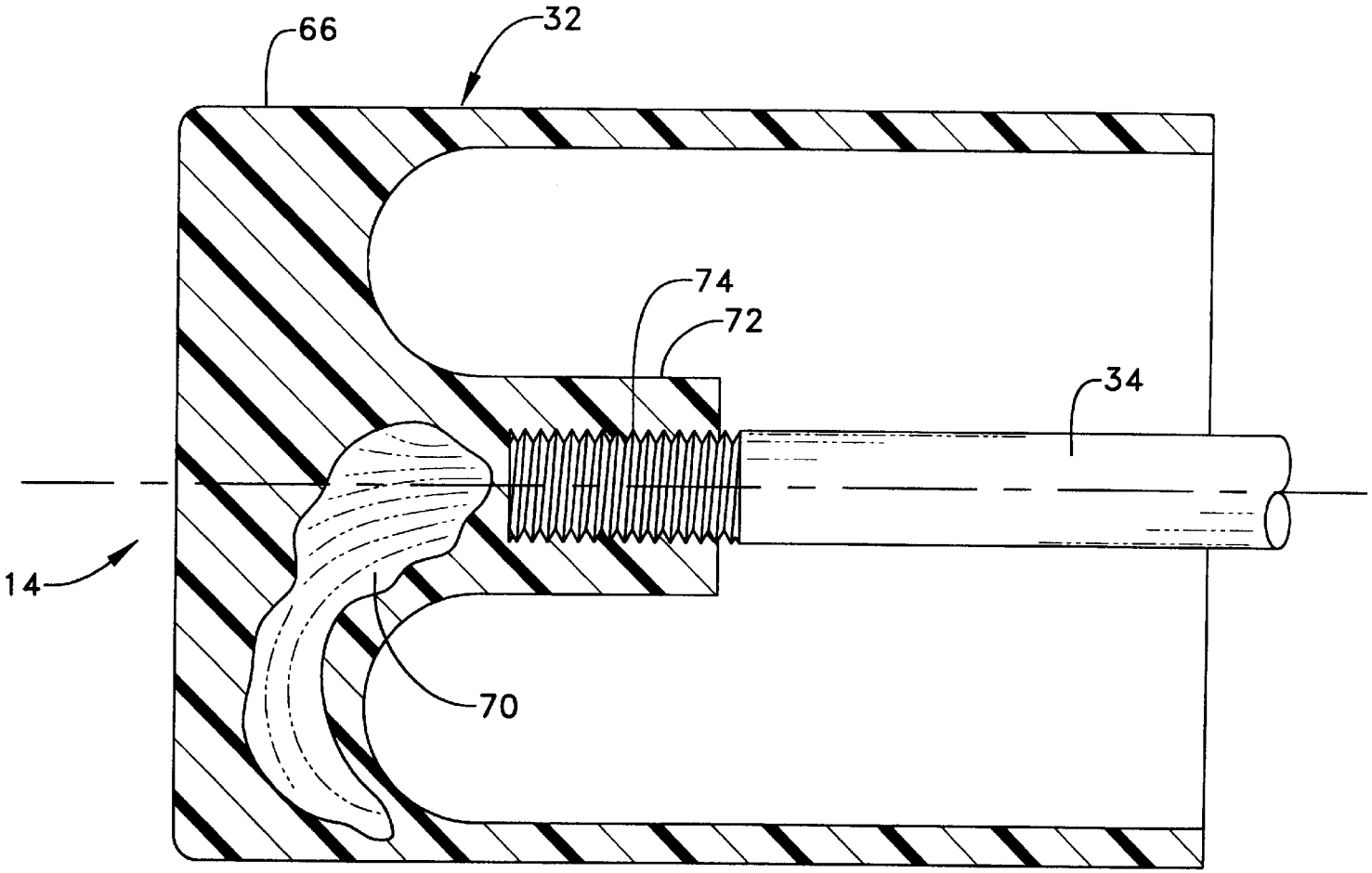
FIG. 2 is a side, sectional view of the piston shown in FIG. 1.

Piston head 32, shown in greater detail in FIG. 2, includes an outside surface 66 which lies closely adjacent to and defines a bearing surface with an inside surface 68 (FIG. 1) of combustion cylinder 16. In the embodiment shown, outside surface 66 of piston head 32 and inside surface 68 of combustion cylinder 16 have a radial operating clearance therebetween of between approximately 0.000 and 0.001 inch, and more preferably approximately 0.000 inch. The term "radial operating clearance", as used herein, means the radial clearance between outside surface 66 of piston head 32 and inside surface 68 of combustion cylinder 16 when free piston engine 10 is under operating conditions. That is, the radial operating clearance is the operating clearance when piston 12 and combustion cylinder 16 are at an operating temperature.

As shown in FIG. 2, outside surface 66 of piston head 32 does not include any piston ring grooves therein, and accordingly does not carry any piston rings. To prevent excessive blow-by of exhaust products during the return stroke of piston 12, and to prevent excessive wear between outside surface 66 and inside surface 68 of combustion cylinder 16, piston head 32 is formed from a material having selected physical properties. More particularly, piston head 32 is formed from a non-metallic material having a relatively low coefficient of thermal expansion, low coefficient of friction and high temperature resistance. Examples of such non-metallic materials which have been found to be suitable include composite materials and ceramic materials. In the embodiment shown, piston head 32 is formed from a carbon-carbon composite material having carbon reinforcing fibers 70 within a carbon matrix. The carbon matrix may include carbon powder within a suitable resin. The carbon reinforcing fibers may be randomly oriented chopped fibers or may be longer filaments which are either randomly oriented or oriented in one or more directions. In the embodiment shown, carbon reinforcing fibers 70 are oriented within piston head 32 generally as shown to provide strength to piston head 32 upon axial loading in either direction by plunger rod 34.

The non-metallic material from which piston head 32 is constructed preferably has a coefficient of thermal expansion of between approximately 0.5 and 10 ppm/° C. In the embodiment shown, the carbon-carbon composite material from which piston head 32 is constructed has a coefficient of thermal expansion of between approximately 1 and 2 ppm/° C. Moreover, the non-metallic material from which piston head 32 is constructed preferably has a coefficient of friction of between 0.01 and 0.15. In the embodiment shown, the carbon-carbon composite material from which piston head 32 is constructed has a coefficient of friction of approximately 0.10. Additionally, the non-metallic material from which piston head 32 is constructed preferably has a temperature resistance of up to between approximately 400° C. and 2500° C. In the embodiment shown, the carbon-carbon composite material from which piston head 32 is constructed has a temperature resistance up to approximately 500° C.

Piston head 32 includes a hub 72 with an internally threaded opening 74 which is threadingly engaged with an outside diameter of plunger rod 34 to thereby rigidly interconnect piston head 32 with plunger rod 34. Other methods of rigidly attaching piston head 32 and plunger rod 34 are of course also possible.

Combustion cylinder 16, in the embodiment shown, includes a longitudinal axis 76 a liner 78 which defines inside surface 68. Liner 78 is formed from a non-metallic material having physical properties which are similar to the non-metallic material from which piston head 32 is formed, as described above. In the embodiment shown, liner 78 is also formed from a carbon-carbon composite material with physical properties which are substantially the same as the carbon-carbon composite material from which piston head 32 is formed. Since the carbon—carbon composite material from which each of outside surface 66 and inside surface 68 are formed has a relatively low coefficient of friction, wear between outside surface 66 and inside surface 68 is minimized. Moreover, since the carbon-carbon composite material from which each of outside surface 66 and inside surface 68 are formed has a relatively low coefficient of thermal expansion, the radial operating clearance therebetween can be maintained at a minimum distance (e.g., 0.000 inch), thereby preventing blow-by of combustion products during operation.

A compression head 44 is disposed between piston head 32 and plunger head 36, and interconnects smaller diameter portion 38 with a larger diameter portion 46 of plunger rod 34. Reciprocating movement of piston head 32 between a BDC position and a TDC position, and vice versa, causes corresponding reciprocating motion of compression head 44 within compression cylinder 18. Compression head 44 includes a plurality of sequentially adjacent lands and valleys 48 which effectively seal with and reduce friction between compression head 44 and an inside surface of compression cylinder 18. Compression cylinder 18 is disposed in communication with fluid ports 50 and 52 generally at opposite ends thereof. Pressurized fluid which is transported into compression cylinder 18 on a side of compression head 44 adjacent to fluid port 50 causes piston 14 to move toward a TDC position during a compression stroke. Conversely, pressurized fluid may be transported through fluid port 52 into compression cylinder 18 in an annular space 54 surrounding larger diameter portion 46 to effect a return stroke of piston 14 at the initial start up or upon the occurrence of a misfire.

Combustion cylinder 16 is fluidly separated from compression cylinder 18 using an annular seal 56 which surrounds larger diameter portion 46 of plunger rod 34. Seal 56 allows sliding movement of larger diameter portion 46 therethrough, but does not support larger diameter portion 46 in a radial direction. Rather, seal 56 only functions to fluidly separate combustion cylinder 16 and compression cylinder 18.

Compression cylinder 18 is fluidly separated from hydraulic cylinder 20 using an annular bearing/seal 58.

Bearing/seal 58 allows sliding movement of smaller diameter portion 38 of plunger rod 34, while at the same time radially supporting smaller diameter portion 38. Since piston head 32 and bearing/seal 58 form the two sliding bearing points of piston 14, it will be appreciated that concentric misalignments associated with manufacturing tolerances between combustion cylinder 16 and hydraulic cylinder 20 and/or concentric misalignments between piston head 32 and plunger rod 34 are accommodated.

In the embodiment shown in FIGS. 1 and 2, piston head 32 is in the form of a non-metallic piston head which does not include any piston rings. However, the piston of the present invention may be configured with a piston head which includes piston ring grooves and piston rings, and/or is constructed from a metallic material.

Moreover, in the embodiment shown in FIGS. 1 and 2, piston head 32 includes a generally flat face on the side facing combustion chamber 28. However, it is to be appreciated that the shape of the face disposed adjacent to combustion chamber 28 may vary, dependent upon the specific application.

Additionally, in the embodiment of free piston engine 10 shown and described above, bearing/seal 58 is used to slidingly carry plunger rod 34, while seal 56 does not carry but only seals with plunger rod 34. However, depending upon the specific application and geometry of free piston engine 10, the exact location of the bearing or bearing/seal which carries plunger rod 34 may vary. For example, seal 56 may be configured as a bearing/seal and bearing/seal 58 may be configured as only a seal.

Figure 3:
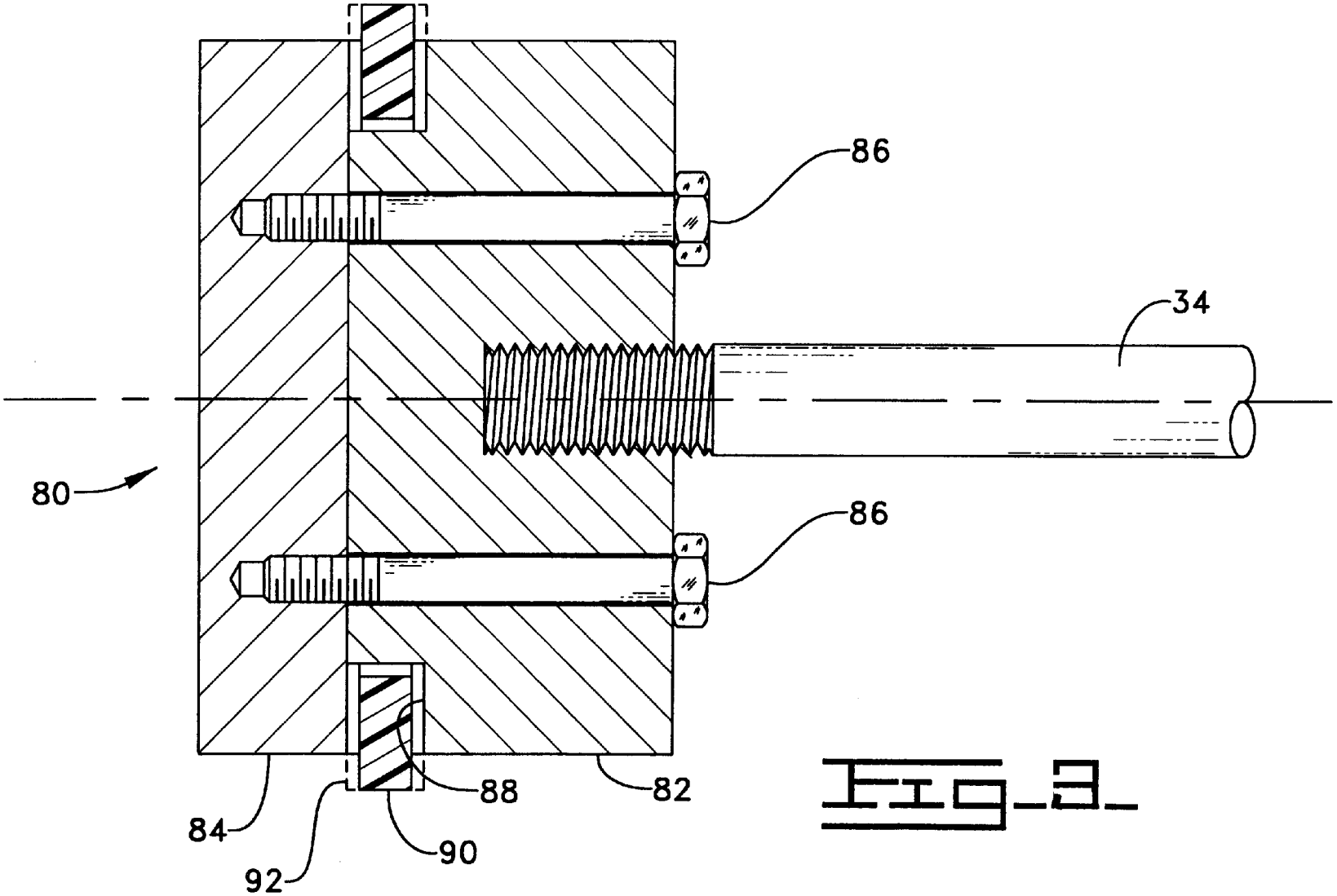
FIG. 3 is a side, sectional view of another embodiment of a piston of the present invention.

Referring now to FIG. 3, there is shown another embodiment of a piston 80 of the present invention which is attached with a plunger rod 34. Piston 80 includes a two-part piston head with a first part 82 which is connected together with a second part 84 using a plurality of bolts 86. First part 82 is threadingly engaged with plunger rod 34. First part 82 and second part 84 define a piston ring groove 88 therebetween which receives a piston ring 90. Piston ring 90 is formed from a non-metallic material, preferably with a relatively low co-efficient of friction and high resistance to temperature extremes. In the embodiment shown, piston ring 90 is formed from either a composite or ceramic material, and preferably is formed from a carbon-carbon composite material with carbon reinforcing fibers in a carbon matrix. Piston ring 90 has a width (extending in a direction generally parallel to a longitudinal extension of bolts 86 and plunger rod 34) which is sufficient to allow piston ring 90 to function as a bearing when disposed within combustion cylinder 16. In the embodiment shown, piston ring 90 includes both axial as well as radial tolerance within piston ring groove 88. However, piston ring 90 may also substantially fill piston ring groove 88, as indicated by phantom lines 92.

Industrial Applicability

During use, piston 14 is reciprocally disposed within combustion cylinder 16. Piston 14 travels between a BDC position and a TDC position during a compression stroke, and between a TDC position and BDC position during a return stroke. Combustion air is introduced into combustion chamber 28 through combustion air inlet 22 and air scavenging channel 24. Fuel is controllably injected into combustion chamber 28 using a fuel injector 30. The non-metallic, carbon-carbon bearing surfaces defined by the outside bearing surface of the piston head and inside surface 68 of combustion cylinder 16 allow piston head 32 to function as a bearing during use, thereby allowing only one other additional bearing which carries plunger rod 34 to be used. Concentric misalignments between combustion cylinder 16 and hydraulic cylinder 20 and/or between the longitudinal axis of plunger rod 34 and piston head 32 are accommodated by allowing piston head 32 to function as one of two bearings slidingly supporting piston 14.

Other aspects, objects and advantages of this invention can be obtained from a study of the drawings, the disclosure and the appended claims.

What is claimed is:

1. A free piston internal combustion engine, comprising:

a housing including a combustion cylinder and a second cylinder;

a piston including a piston head reciprocally disposed within said combustion cylinder, a second head reciprocally disposed within said second cylinder, and a plunger rod rigidly attached to each of and interconnecting said piston head and said second head, said piston head defining a bearing with said inside surface of said combustion cylinder; and a single bearing carried by said housing within said second cylinder and reciprocally carrying said plunger rod, said single bearing being the only bearing which directly carries said plunger rod.

2. The free piston internal combustion engine of claim 1, wherein said second cylinder comprises a hydraulic cylinder and said second head comprises a plunger head.

3. The free piston internal combustion engine of claim 2, wherein said housing further includes a compression cylinder and said piston further includes a compression head reciprocally disposed within said compression cylinder, said compression head attached to said plunger rod and disposed between said piston head and said plunger head.

4. The free piston internal combustion engine of claim 3, further comprising a seal carried by said housing within said compression cylinder and surrounding said plunger rod, said seal fluidly separating said combustion cylinder and said compression cylinder.

5. The free piston internal combustion engine of claim 4, wherein said single bearing comprises a bearing/seal which fluidly separates said compression cylinder and said hydraulic cylinder.

6. The free piston internal combustion engine of claim 1, wherein said combustion cylinder defines a first longitudinal axis and said second cylinder defines a second longitudinal axis, said single bearing and said piston head which acts as a bearing accommodating concentric misalignments between said first longitudinal axis and said second longitudinal axis.

7. The free piston internal combustion engine of claim 1, wherein said piston head has a cylindrical outside surface defining a bearing surface with said inside surface of said combustion cylinder.

8. The free piston internal combustion engine of claim 7, wherein said piston head is constructed from a non-metallic material.

9. The free piston internal combustion engine of claim 8, wherein said non-metallic material is selected from the group consisting of composite and ceramic materials.

10. The free piston internal combustion engine of claim 9, wherein said non-metallic material consists essentially of a carbon-carbon composite material having carbon reinforcing fibers within a carbon matrix.

11. The free piston internal combustion engine of claim 8, wherein said non-metallic material has a coefficient of thermal expansion of between 0.5 and 10 ppm/° C.

12. The free piston internal combustion engine of claim 11, wherein said non-metallic material has a coefficient of thermal expansion of between 1 and 2 ppm/° C.

13. The free piston internal combustion engine of claim 8, wherein said non-metallic material has a coefficient of friction of between 0.01 and 0.15.

14. The free piston internal combustion engine of claim 13, wherein said non-metallic material as a coefficient of friction of approximately 0.10.

15. The free piston internal combustion engine of claim 8, wherein said non-metallic material has a temperature resistance up to between 400° C. and 2500° C.

16. The free piston internal combustion engine of claim 15, wherein said non-metallic material has a temperature resistance up to approximately 500° C.

17. The free piston internal combustion engine of claim 1, wherein said outside surface of said piston head and said inside surface of said combustion cylinder have a radial operating clearance therebetween of between 0.000 and 0.001 inch.

18. The free piston internal combustion engine of claim 17, wherein said outside surface of said piston head and said inside surface of said combustion cylinder have a radial operating clearance therebetween of approximately 0.000 inch.

19. The free piston internal combustion engine of claim 1, wherein said piston head includes a piston ring groove and a piston ring disposed in said piston ring groove, said piston ring defining said bearing with said inside surface of said combustion cylinder.

20. The free piston internal combustion engine of claim 19, wherein said piston ring is constructed from a non-metallic material.

21. The free piston internal combustion engine of claim 9, wherein said piston ring is constructed from a material consisting essentially of a carbon-carbon composite material having carbon reinforcing fibers within a carbon matrix.

* * * * *